US009249697B2

(12) United States Patent
Doller

(10) Patent No.: US 9,249,697 B2
(45) Date of Patent: Feb. 2, 2016

(54) DEVICE FOR A VALVE TRAIN FOR CHANGING THE LIFT OF GAS EXCHANGE VALVES OF AN INTERNAL COMBUSTION ENGINE

(71) Applicant: IAV GmbH Ingenieurgesellschaft Auto und Verkehr, Berlin (DE)

(72) Inventor: Steffen Doller, Reichenbach (DE)

(73) Assignee: IAV GMBH INGENIEURGESELLSCHAFT AUTO UND VERKEHR, Berlin (DE)

( * ) Notice: Subject to any disclaimer, the term of this patent is extended or adjusted under 35 U.S.C. 154(b) by 0 days.

(21) Appl. No.: 14/394,751

(22) PCT Filed: Apr. 26, 2013

(86) PCT No.: PCT/DE2013/000236

§ 371 (c)(1),
(2) Date: Oct. 16, 2014

(87) PCT Pub. No.: WO2013/159765

PCT Pub. Date: Oct. 31, 2013

(65) Prior Publication Data

US 2015/0059677 A1 Mar. 5, 2015

(30) Foreign Application Priority Data

Apr. 27, 2012 (DE) ..... 10 2012 008 555

(51) Int. Cl.
*F01L 1/18* (2006.01)
*F01L 13/00* (2006.01)

(52) U.S. Cl.
CPC ..... *F01L 13/0015* (2013.01); *F01L 13/0036* (2013.01); *F01L 2013/0078* (2013.01)

(58) Field of Classification Search
CPC ..... F01L 13/0015; F01L 13/0036; F01L 2013/0078
USPC ..... 123/90.18, 90.44, 90.6
See application file for complete search history.

(56) References Cited

U.S. PATENT DOCUMENTS 5,129,407 A 7/1992 Phillips
8,230,833 B2 * 7/2012 Werler ..... F01L 1/34413 123/90.16

(Continued)

FOREIGN PATENT DOCUMENTS

DE 19520117 A1 12/1996
DE 102004022833 A1 12/2005

(Continued)

*Primary Examiner* — Ching Chang
(74) *Attorney, Agent, or Firm* — Leydig, Voit & Mayer, Ltd.

(57) ABSTRACT

The invention relates to a device for a valve train for changing the lift of gas exchange valves of an internal combustion engine, having a camshaft rotatably mounted in a housing, which camshaft consists of an arrangement of, in succession coaxially from the inside to the outside, at least one push rod, at least one carrier shaft and at least one cam unit provided with at least two different cams and at least one thrust pin, and the cam shaft is surrounded at least partially by at least one shift gate mounted non-rotatably and axially movably in the housing. At least one change-over pin and at least one support pin are immovably connected to the push rod, wherein the change-over pin and the support pin extend in openings at least right through the carrier shaft and the change-over pin can be brought into operative contact with at least one switching contour on the shift gate and the support pin can be brought into operative contact with at least one support contour on the shift gate.

8 Claims, 4 Drawing Sheets

(56) References Cited

U.S. PATENT DOCUMENTS

| | | | |
|---|---|---|---|
| 8,596,238 | B2 | 12/2013 | Werler et al. |
| 2010/0139594 | A1 | 6/2010 | Wutzler et al. |
| 2010/0251982 | A1 | 10/2010 | Elendt et al. |
| 2011/0203541 | A1 | 8/2011 | Meintschel et al. |
| 2012/0006292 | A1 | 1/2012 | Elendt et al. |
| 2012/0037106 | A1 | 2/2012 | Werler et al. |

FOREIGN PATENT DOCUMENTS

| | | | |
|---|---|---|---|
| DE | 102007022145 | A1 | 1/2008 |
| DE | 102007016977 | A1 | 10/2008 |
| DE | 102007061353 | A1 | 6/2009 |
| DE | 102008050776 | A1 | 4/2010 |
| DE | 102010013216 | A1 | 10/2010 |
| DE | 102009021650 | A1 | 11/2010 |
| DE | 102009030373 | A1 | 12/2010 |
| DE | 102009037269 | A1 | 3/2011 |
| DE | 102009039733 | A1 | 3/2011 |
| DE | 102010021903 | A1 | 12/2011 |
| WO | WO 2008012306 | A1 | 1/2008 |
| WO | WO 2010115399 | A1 | 10/2010 |

* cited by examiner

DEVICE FOR A VALVE TRAIN FOR CHANGING THE LIFT OF GAS EXCHANGE VALVES OF AN INTERNAL COMBUSTION ENGINE

CROSS-REFERENCE TO RELATED APPLICATIONS

This application is a U.S. National Stage Application under 35 U.S.C. §371 of International Application No. PCT/DE2013/000236 filed on Apr. 26, 2013, and claims benefit to German Patent Application No. DE 10 2012 008 555.9 filed on Apr. 27, 2012. The International Application was published in German on Oct. 31, 2013 as WO 2013/159765 A1 under PCT Article 21(2).

FIELD

The present invention relates to a device for a valve train for changing the lift of gas exchange valves of an internal combustion engine with a push rod running parallel to a camshaft.

BACKGROUND

Valve train devices that have a mechanism for changing the lift of gas exchange valves are already known. The invention is based on a valve train, in which the gas exchange valves, in particular inlet valves and outlet valves of an internal combustion engine, are directly or indirectly actuated by means of a camshaft. Cams that are adjacent on the camshaft and have different cam shapes, which cams are combined to form a cam unit, are provided to change the valve lift. By means of an axial movement of the cam units on the camshaft, one cam of the cam group in each case is made to engage with the corresponding gas exchange valve and the lift of the gas exchange valves is produced in accordance with the cam shape. A push rod, which runs parallel to the camshaft, with corresponding elements for engagement on the cam units, is provided to move the cam units.

A valve train for gas exchange valves of an internal combustion engine with a movable cam carrier having a continuous groove running over the periphery emerges from the published application DE 10 2007 061 353 A1. The cam carrier is non-rotatably but axially movably mounted on a camshaft and has a plurality of axially spaced-apart cams with different cam elevations, which are combined to form a cam group for the respective gas exchange valve. An engagement element, which carries out a lift in the axial direction according to the course of the continuous groove, engages continuously in the continuous groove. The engagement element can be locked in specific positions, so the cam carrier is forced to carry out an axial movement to thus change over between the cams to drive a gas exchange valve.

However, the system described requires a great deal of installation space, so it is only possible to use it in internal combustion engines with adequate cylinder spacing. Furthermore, an actuator is necessary to lock the engagement element for each movable cam carrier, said actuator having to be activated at the correct time.

The published application DE 10 2009 030 373 A1 describes a valve train for an internal combustion engine with a variable lift gas exchange valve actuation. The cam shaft of the valve train comprises a carrier shaft and a cam piece, which is non-rotatably but axially movable thereon. The cam piece contains cam groups of directly adjacent cams with different elevations. A gate is provided at the end of the cam piece in order to axially move the cam piece in relation to the carrier shaft by coupling in an actuating element. The cam piece revolving with the carrier shaft is mounted in a camshaft bearing.

The adjusting gate on the cam piece is arranged outside the cam shaft bearing, so additional axial installation space is produced for each cam piece. A separate actuating element is required for each adjustment direction. As a result, two actuators are used for each cylinder of the internal combustion engine. This increased control outlay and component outlay in conjunction with the space requirement is a main drawback of the device.

A valve train with variable lift gas exchange valve actuation emerges from the published application D10 2010 013 216 A1. The valve train consists of a camshaft, which is constructed from a carrier shaft and cam pieces mounted non-rotatably but axially movably thereon. A cam group of directly adjacent cams with different elevations and an axial gate is located on the cam piece. The cam piece is also provided with a bearing journal and mounted thereby in a cam shaft bearing. The bearing journal on the adjacent axial gate are overlapped by the camshaft bearing, so the actuating element is positioned on the camshaft bearing to move the cam piece and runs radially through the bearing point to engage in the axial gate.

As the axial gate and also the bearing journal are overlapped by the camshaft bearing, the bearing point has to be particularly wide to provide the required bearing face in accordance with the bearing loads. This leads to an increased installation space requirement. The system can only be used in internal combustion engines with adequately large valve spacing or cylinder spacing. Moreover, an actuating element is also required in each case in this system for each cam piece. This stands in the way of the current development aim of compact internal combustion engines.

A changeable valve train of an internal combustion engine is described in the published application DE 10 2007 022 145 A1. The camshaft of the valve train comprises a drive shaft with at least one cam piece non-rotatably but axially movably arranged thereon with a group of axially adjacent cams. The cams have different cam elevations here. The cam piece is radially supported together with the drive shaft and with an additional bearing bush coaxially mounted on the cam piece in a cam shaft bearing point. The additional bearing bush is axially movable together with the cam piece in relation to the camshaft bearing point and the drive shaft, the bearing bush being secured against rotation in the camshaft bearing point. The cam piece and the bearing bush are thus accordingly arranged coaxially one above the other on the drive shaft and mounted in the camshaft bearing point. A pin is positioned in the bearing bush parallel to the rotational axis of the drive shaft, said pin carrying out an oscillating movement by means of a guide introduced in the revolving cam piece with an axial lift. To initiate a switching process, the pin is briefly axially fixed by a fixing mechanism at the corresponding point. As a result, the cam piece is supported on the fixed pin. The cam piece is forced to carry out an axial movement and a switching process is initiated.

The complex control and the component outlay connected therewith are to be mentioned as the drawback of this device for changing the lift. A separate fixing mechanism, which has to initiate a switching process at the right time, has to be provided for each changeover device of a cam piece. The pin moreover leads to high loads in the guide groove during the switching process. Furthermore, a high degree of wear is to be expected on the pin as the pin has to be clamped for each switching process.

U.S. Pat. No. 5,129,407 A describes an adjusting device for a camshaft, with which the camshaft can be axially moved. Owing to the movement of the camshaft, different cams with different cam elevations can be positioned to actuate the gas exchange valves. An axial gate, with which an axial movement in the two directions is made possible, is provided to move the camshaft. For this purpose, the gate has two contours running mirror-symmetrically over the periphery, each of the two contours producing the lift required for the adjustment to adjust the camshaft. Provided between the two contours is a region, in which the adjusting pin that is permanently engaged can be positioned without contact with one of the two peripheral contours. To initiate a switching process, the adjusting pin is moved in the axial direction and fixed in order to come into contact with one of the two contours and to initiate the axial adjustment of the camshaft in the corresponding direction.

The camshafts and the cams positioned thereon of modern internal combustion engines with a plurality of cylinders do not, however, allow a simultaneous adjustment of the cams nor, therefore, a movement of the entire camshaft as no overlapping of the cam base circles is produced between the various cylinders. Moreover, the gate causes an enlargement of the overall length of the camshaft.

A valve train for gas exchange valves of an internal combustion engine is known from the published application DE 10 2009 039 733 A1, in which a cam unit with a plurality of different can tracks arranged next to one another is non-rotatably and axially movably mounted on a camshaft and the cam unit can be axially moved by an adjusting means. The adjusting means comprises an adjusting element movably mounted within the camshaft to transmit the adjusting movement to the cam unit. For this purpose, the adjusting element has, on its periphery, a running track profile, which cooperates with a coupling element, the coupling element furthermore being connected by a recess in the camshaft to the cam unit. An axial movement of the cam unit on the camshaft is brought about by a movement of the adjusting element relative to the camshaft. It is described as a configuration variant that the adjusting element is rotatably mounted in the camshaft and that the running track profile substantially extends in the peripheral direction on the adjusting element. The change between two cam tracks on the cam unit to actuate the gas exchange valves is achieved by an axial offset in the running track profile, which is produced by a relative rotation of the adjusting element in relation to the camshaft.

SUMMARY

The object of the invention is to provide a device for a valve train for changing the lift of gas exchange valves of an internal combustion engine, in which the required installation space, the technical outlay and the mechanical loads of the adjusting device are to be reduced.

The object is achieved by a device having the features of claim 1 and a method having the features of claim 7.

DETAILED DESCRIPTION

The invention provides a device, with which the lift of gas exchange valves of a valve train of an internal combustion engine can be varied in a particularly advantageous manner during the operation of the internal combustion engine.

For this purpose, a camshaft of the valve train is constructed from a carrier shaft configured as a hollow shaft and at least one cam unit mounted on the carrier shaft. The at least one cam unit is non-rotatably but axially movably connected to the carrier shaft. At least one cam group of axially adjacent cams with an identical base circle but with different cam contours and/or different cam elevations is located on the cam unit. A gas exchange valve, which is used as an outlet valve or inlet valve, is associated with at least one cam group. The gas exchange valve associated with the cam group alternately has an operative connection to one of the various cams of the cam group. One cam of the associated cam group can be brought into operative contact with the gas exchange valve by an axial movement of the cam unit in relation to the gas exchange valve. The movement takes place when the associated gas exchange valve is in operative contact with the respective cam in the region of the base circle.

The cam unit is axially moved by means of a shift gate at least partially surrounding the cam unit and a push rod arranged coaxially with respect to the carrier shaft. The shift gate is axially movable in a housing for a first and at least one further switching position and non-rotatably mounted in relation to the cam unit and has at least one switching contour and at least one support contour. The push rod is axially movably mounted within the carrier shaft and non-rotatably connected to the carrier shaft. This produces an arrangement of, coaxially from the inside to the outside, the push rod, carrier shaft, cam unit and shift gate, all the adjacent elements being axially movably mounted in relation to one another. The shift gate comprises here, in the peripheral direction, only one part region of the camshaft. Mechanisms for the axial movement and the axial locking of the push rod are provided on at least one end of the push rod. The push rod can be axially moved by these mechanisms from a first position into at least one further position and axially locked in the respective position.

At least three pins are provided for at least one axially movable cam unit, wherein a first pin is immovably connected as a changeover pin to the push rod and can be brought into operative contact with the at least one switching contour of the shift gate through openings in the carrier shaft and cam unit. A second pin is connected as a support pin to the push rod and can be brought into operative contact with the at least one support contour of the shift gate through openings in the carrier shaft and cam unit. A third pin is immovably connected as a thrust pin to the cam unit and can be brought into operative contact with the switching contour of the shift gate. The openings in the carrier shaft and cam unit are configured here in such a way that an axial movement of the push rod, carrier shaft and cam unit in relation to one another is made possible.

The at least three pins are arranged in relation to one another in such a way that, in a first operative chain, a continuous operative contact of the push rod with the changeover pin to the shift gate can be produced and in at least one further operative chain a continuous operative contact of the push rod with the support pin to the shift gate, of the shift gate to the thrust pin and accordingly to the cam unit can be produced.

The changeover pin is arranged on the push rod in such a way that the changeover pin can engage in the switching contour of the shift gate that is not co-rotating owing to the rotation of the camshaft in order to bring about an axial movement of the shift gate in relation to the push rod and to prepare a changeover process between the different cams. During the operative contact of the first operative chain, in other words during the axial movement of the shift gate, the thrust pin is located outside the switching contour and the support pin is located outside the support contour.

The thrust pin on the cam unit and the support pin on the push rod are advantageously arranged for the further operative chain in such a way that they preferably engage simultaneously in the switching contour and in the support contour.

The thrust pin and the support pin are arranged axially spaced apart in relation to one another, the axial spacing being changed by the movement of the push rod and/or by the movement of the cam unit. The thrust pin and the support pin are arranged spaced apart from the changeover pin in the peripheral direction in such a way that the thrust pin follows the changeover pin during the rotation of the camshaft to engage in the shift gate. The thrust pin and the support pin are thus arranged spaced apart from the changeover pin in an opposing manner to the rotational direction of the cam shaft, so they firstly engage in the shift gate when the changeover pin has left the switching contour.

The switching contour of the shift gate, in relation to the camshaft, is configured as a contour that is axially variable in the peripheral direction. If the changeover pin or the thrust pin is brought into operative contact with the switching contour, a relative axial movement of the changeover pin or thrust pin with respect to the shift gate takes place. For this purpose, the switching contour is configured in such a way that owing to the rotation of the camshaft, the respective pin moves by means of the switching contour of the shift gate that is not co-rotating and an axial lift is produced in the process between the respective pin and the shift gate. In an advantageous manner, two mirror-symmetrically opposing switching contours are provided on the shift gate in order to allow an axial movement in the two directions of the shift gate and cam unit in relation to the carrier shaft. A first and a second switching contour are accordingly arranged in such a way that the perpendicular spacing of the switching contours from one another reduces in the rotational direction of the camshaft. The smallest spacing is at least so great that the changeover pin or the thrust pin can travel unhindered between the two switching contours without bringing about an axial movement in the process.

The support contour of the shift gate, in relation to the camshaft, is configured as a contour running axially constantly in the peripheral direction. If the support pin is brought into operative contact with the support contour, no relative movement of the support pin or push rod and shift gate takes place. In an advantageous manner, two mirror-symmetrically opposing support contours are provided on the shift gate in order to assist an axial movement in the two directions of the shift gate and cam unit in relation to the carrier shaft or the push rod. A first and a second support contour are accordingly arranged in such a way that the perpendicular spacing of the support contours in relation to one another remains constant and is at least so great that the support pin can travel unhindered between the two support contours.

Accordingly, the invention provides a device for a valve train for changing the lift of gas exchange valves of an internal combustion engine, having a camshaft rotatably mounted in a housing, which camshaft consists of an arrangement of, in succession coaxially from the inside to the outside, at least one push rod, at least one carrier shaft and at least one cam unit provided with at least two different cams and at least one thrust pin, and the camshaft is surrounded at least partially by at least one shift gate mounted non-rotatably and axially movably in a housing. At least one changeover pin and at least one support pin are immovably connected to the push rod, wherein the changeover pin and the support pin extend in openings at least right through the carrier shaft and the changeover pin can be brought into operative contact with at least one switching contour on the shift gate and the support pin can be brought into operative contact with at least one support contour on the shift gate. The shift gate has a first switching contour, a second switching contour opposing the first switching contour, a first support contour and a second support contour opposing the first support contour. The switching contour, in relation to the camshaft, is configured as a contour that is axially variable in the peripheral direction and accordingly produces an axial lift between the changeover pin or thrust pin and the shift gate owing to the rotation of the cam shaft in relation to the shift gate. The support contour, in relation to the camshaft, is configured as a contour that is axially non-variable in the peripheral direction. In an advantageous configuration, the switching contours and the support contours are arranged next to one another on the shift gate. The changeover pin is arranged on the cam shaft spaced apart from the thrust pin and the support pin in the peripheral direction and axially spaced apart from the support pin.

For internal combustion engines with a plurality of gas exchange valves for each cylinder, a cam group may be associated with each gas exchange valve. Advantageously, one cam group is associated with at least one inlet valve. In internal combustion engines with a plurality of inlet valves for each cylinder, the cam groups of the respective inlet valve may be combined to form a common cam unit, wherein a synchronous lift changeover can take place between the various cams with various cam contours or cam elevations of the respectively associated gas exchange valve. Furthermore, the cam groups of cylinders located next to one another may be arranged on a common cam unit. Thus, for example, a total of four cam groups is located on one cam unit for an internal combustion engine with four cylinders and two inlet valves in each cylinder. In order to allow a changeover for all the cylinders, a total of two cam groups should then be provided. The cams of the respectively associated cam groups, which are simultaneously in contact with the gas exchange valves, may have the same cam contours or cam elevations for a symmetrical valve lift or else have different cam contours or cam elevations in order to produce an asymmetric valve lift. Advantageously, a cam without a cam elevation may also be provided in the cam group to implement a switching off of a valve.

The first operative chain is produced for a changeover process between the cams of the cam unit during the rotation of the cam shaft in a first direction. The shift gate, proceeding from a neutral position, in which the changeover pin and the thrust pin can travel unhindered between the two switching contours, is moved into the first switching position. For this purpose, an axial movement of the push rod is initiated by the mechanisms provided on the push rod and the changeover pin is axially moved together with a support pin. The changeover pin, upon a further rotation of the camshaft, travels into the shift gate and comes into operative contact with the first switching contour of the shift gate. The shift gate is axially moved by the course of the switching contour as the push rod is supported by the mechanisms for axial locking of the push rod after the completed axial movement. The axial movement of the shift gate corresponds here to the axial lift of the shift contour, which is produced by the operative contact between the switching contour and changeover pin.

As soon as the shift gate has been axially moved into the first switching position, the first operative chain is cancelled and the further operative chain is produced. By means of the further rotation of the camshaft, the thrust pin engages in the shift gate and the operative contact between the thrust pin and the first switching contour is produced. At the same time the support pin engages in the shift gate and the operative contact between the support pin and the first support contour is produced. Owing to the further rotation of the cam shaft and the course of the switching contour, the cam unit with the thrust pin is axially moved as the shift gate is axially locked by means of the support pin with the push rod. The axial movement of the cam unit corresponds here to the axial lift of the switching contour, which is produced by the operative contact between the switching contour and thrust pin.

A method is provided for changing the lift of gas exchange valves of an internal combustion engine using the device according to the invention, in which a first operative chain with a continuous operative contact of the push rod with the changeover pin to the shift gate is produced and the shift gate is axially moved in relation to the carrier shaft, and after the movement of the shift gate, the first operative chain is cancelled and a further operative chain with a continuous operative contact of the push rod with the support pin to the shift gate, of the shift gate to the thrust pin and accordingly to the cam unit is produced and the cam unit is moved in relation to the carrier shaft.

A locking actuator is extended from a locking contour on the push rod, in succession for this, during the rotation of the camshaft and an adjusting actuator is retracted into an adjusting contour on the push rod, whereupon the push rod is axially moved. Once the movement has ended, the adjusting actuator is extended from the adjusting contour and a locking actuator is retracted into a locking contour. The changeover pin then acts on the switching contour of the shift gate and brings about a movement of the shift gate. The thrust pin then acts on the switching contour and the support pin acts on the support contour and a movement of the cam unit takes place, whereby the changeover between two adjacent cams is completed.

The first operative chain is produced for a changeover process in a further switching direction opposing the first switching direction in that the shift gate is moved in such a way that the changeover pin comes into operative contact with the second switching contour and the further operative chain is produced in that the thrust pin comes into operative contact with the second switching contour and the support pin comes into operative contact with the second support contour.

By means of the corresponding configuration of the mechanisms for the axial movement and axial locking of the push rod, a changeover can be made between at least two cams of the cam unit. These mechanisms are configured advantageously according to the invention as actuators with a pin, which engage in locking contours or adjusting contours on the push rod. A separate locking contour, which is configured as a closed peripheral groove without an axial lift, is provided for each axial position of the push rod. At least one locking actuator engages in the locking contour associated in accordance with the position of the push rod in order to lock the push rod or to support it. The adjusting contour is also configured as a closed, peripheral groove, the groove producing a changing axial lift. A multiply-stepped lift course is provided for multiple switchings. An adjusting actuator engages in the adjusting contour in order to produce an axial movement of the push rod. The push rod can be moved between at least two or more positions owing to the number of locking contours, the number of adjusting contours or the configuration of a single adjusting contour. As a result, the possibility is produced of switching over between at least two or more cams of a cam unit.

BRIEF DESCRIPTION OF THE DRAWINGS

An embodiment of a device according to the invention is shown here by way of example. In the associated drawings.

Figure 1:
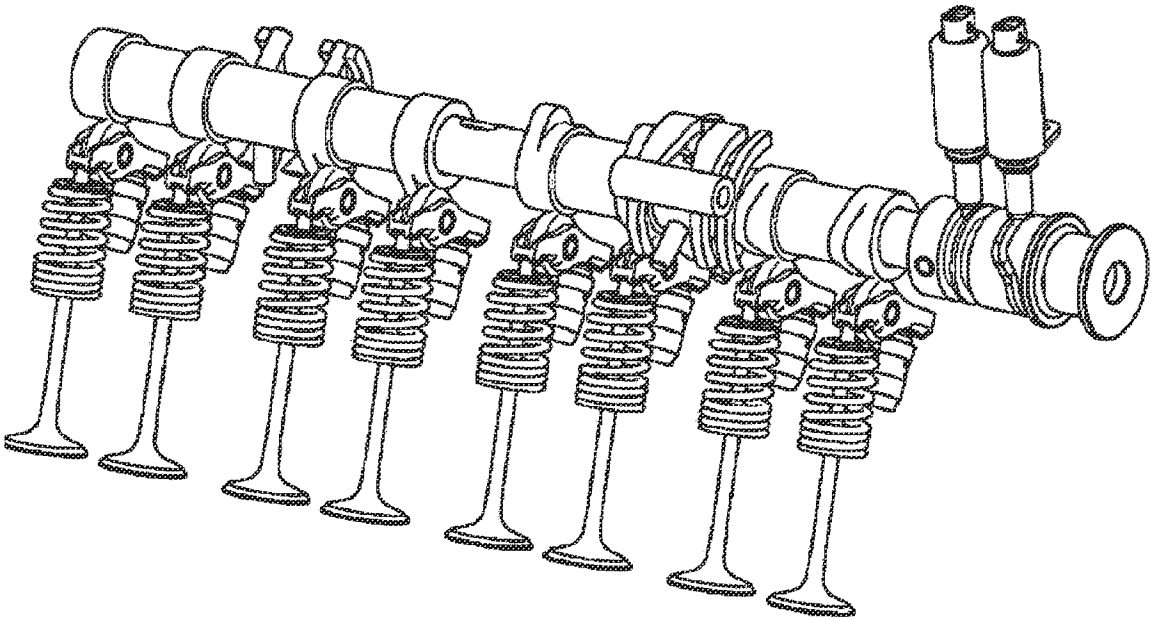
FIG. 1 is a schematic view of a device according to the invention for a valve train for changing the lift of gas exchange valves of an internal combustion engine.
Figure 2:
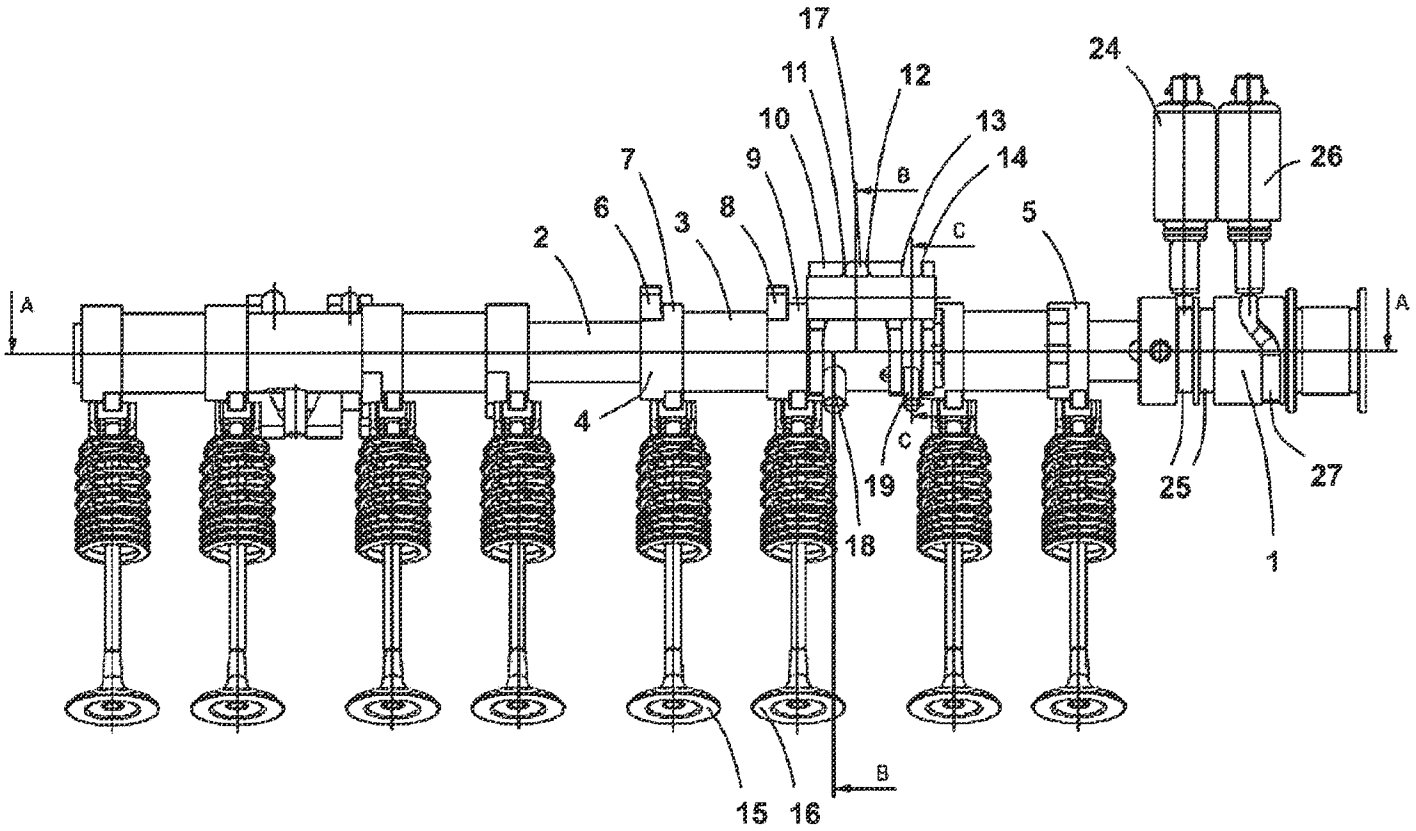
FIG. 2 is a schematic front view of the device.
Figure 3:
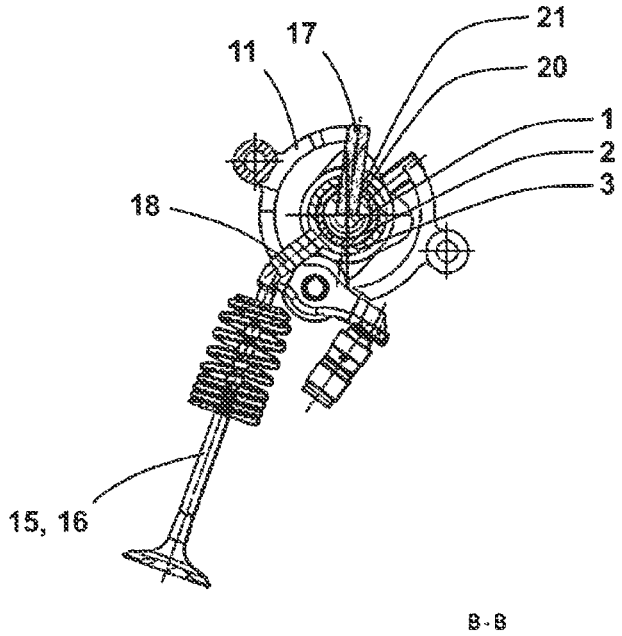
FIG. 3 is a first schematic sectional view of the device.
Figure 4:
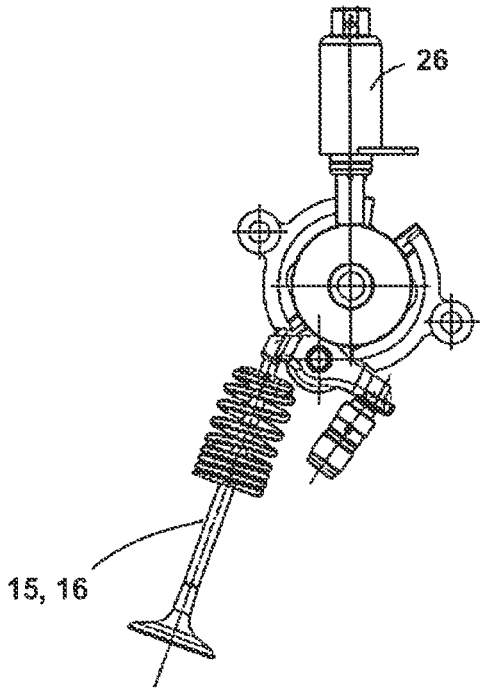
FIG. 4 is a schematic side view of the device.
Figure 5:
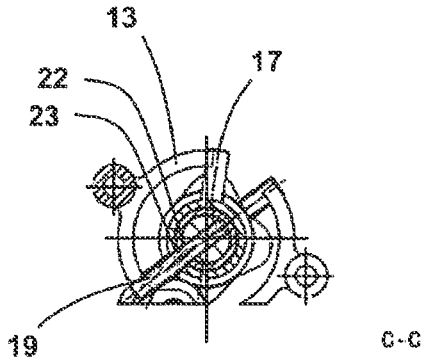
FIG. 5 is a second schematic sectional view of the device.

The device according to the invention, shown in FIGS. 1 to 5, consists of a camshaft, which is constructed from a coaxial arrangement of a push rod 1, a carrier shaft 2 and a cam unit 3. The camshaft 2 is configured as a hollow shaft, so the latter can non-rotatably but axially movably receive the push rod 1. The cam unit 3 is non-rotatably but axially movably arranged on the carrier shaft 2 and has two cam groups 4, 5 of, in each case, two different cams 6, 7, 8, 9.

A first cam 6, 8 or a second cam 7, 9 of the respective cam group 4, 5 is oriented in each case with respect to an associated gas exchange valve 15, 16 by a shift gate 10 with switching contours 11, 12 and support contours 13, 14 in order to actuate the gas exchange valve 15, 16 in accordance with a cam elevation on the cams 6, 7, 8, 9. The shift gate 10 only partially surrounds the camshaft and is axially movably and non-rotatably mounted in a housing (not shown). The first cam 6, 8 of each cam group 4, 5 has a cam contour with a cam elevation, with which the gas exchange valve 15, 16 is actuated and accordingly produces a lift of the gas exchange valve 15, 16. The second cam 7, 9 of the respective cam group 4, 5 has a cam contour without a cam elevation, so the associated gas exchange valve 15, 16 remains closed during the rotation of the cam shaft.

Three pins are provided for the movement of the cam unit 3 by the shift gate 10: a changeover pin 17 rigidly connected to the push rod 1, a thrust pin 18 rigidly connected to the cam unit 3 and a support pin 19 rigidly connected to the push rod 1. The changeover pin 17 and the support pin 19 are positioned in openings 20, 21, 22, 23 in the carrier shaft 2 and cam unit 3, so the latter can come into operative contact during the rotation of the camshaft with the contours 11, 12, 13, 14 in the shift gate 10. The thrust pin 18 and the support pin 19 are axially spaced apart from one another and are arranged on the same position in relation to one another in the peripheral direction. The changeover pin 17 is arranged spaced apart from the thrust pin 18 and support pin 19 in the peripheral direction in such a way that upon rotation of the cam shaft, either the changeover pin 17 or the thrust pin 18 and the support pin 19 engage in the shift gate 10.

A locking actuator 24, which engages in an associated locking contour 25 in a corresponding position of the push rod 1, is provided for the axial locking of the push rod 1. The locking contour 25 is configured as a peripherally closed groove without an axial lift. An adjusting contour 27, which is configured as a closed peripheral groove with a changing axial lift, is provided for the axial movement of the push rod 1. An adjusting actuator 26 engages in the adjusting contour 27 in order to produce an axial movement of the push rod 1.

EMBODIMENT OF A METHOD FOR THE LIFT CHANGEOVER

An embodiment of a method according to the invention is shown here by way of example using the device according to the invention.

To initiate a changeover between two cams 6, 7, 8, 9, an axial movement of the push rod 1 is carried out during the rotation of the camshaft. For this purpose, the axial locking of the push rod 1 is cancelled in that the locking actuator 24 is moved out of the locking contour 25. The push rod 1 is now axially movable and is moved by a corresponding engagement of the adjusting actuator 26 in the adjusting contour 27. The engagement of the adjusting actuator 26 has to take place in that rotational phase of the push rod 1, in which the adjusting contour 27 produces an axial lift in the direction of the adjustment direction to be carried out.

The changeover pin 17 and the support pin 19 are moved relative to the carrier shaft 2 by the axial movement. After the axial movement of the push rod 1, the latter is axially locked again by the locking actuator 24 and the corresponding locking contour 25. The shift gate 10 is firstly moved by the changeover pin 17 relative to the carrier shaft 2 by the position of the changeover pin 17 and the shift gate 10. For this purpose, the changeover pin 17 engages in the shift gate 10 and comes into operative contact with the switching contour 11, 12 and moves the shift gate 10 in accordance with the lift of the switching contour 11, 12. The movement of the shift gate 10 is assisted by the changeover pin 17 and by the push rod 1 in the locking actuator 24.

Following this, by the further rotation of the camshaft, the cam unit 3 is moved relative to the carrier shaft 2 by the thrust pin 18 and the support pin 19. For this purpose, the thrust pin 18 engages in the switching contour 11, 12 of the shift gate 10 and the support pin 19 engages in the support contour 13, 14. The shift gate 10 is axially locked by the support pin 19 and by the push rod 1 by means of the locking actuator 24. The thrust pin 18 comes into operative contact with the switching contour 11, 12 and moves the cam unit 3 in accordance with the lift of the switching contour 11, 12 in relation to the carrier shaft 2. All the pins 17, 18 and 19 are now located, as at the beginning of the changeover process, in a position in which the shift gate 10 can travel through unhindered.

LIST OF REFERENCE NUMERALS

1 push rod
2 carrier shaft
3 cam unit
4, 5 cam group
6, 8 first cam
7, 9 second cam
10 shift gate
11, 12 switching contour
13, 14 support contour
15, 16 gas exchange valve
17 changeover pin
18 thrust pin
19 support pin
20, 21, 22, 23 openings
24 locking actuator
25 locking contour
26 adjusting actuator
27 adjusting contour

The invention claimed is:

1. A device for a valve train for changing the lift of gas exchange valves of an internal combustion engine, the device comprising a camshaft rotatably mounted in a housing, wherein the camshaft comprises an arrangement of, disposed in order coaxially from the inside to the outside:

at least one push rod;

at least one carrier shaft; and at least one cam unit having at least two different cams and at least one thrust pin, wherein the push rod, carrier shaft and cam unit are mounted axially movably and non-rotatably in relation to one another, and the camshaft is surrounded at least partially by at least one shift gate mounted non-rotatably and axially movably, wherein at least one changeover pin and at least one support pin are immovably connected to the push rod, and wherein the changeover pin and the support pin extend in openings that extend through the carrier shaft and the changeover pin can be brought into operative contact with at least one switching contour on the shift gate and the support pin can be brought into operative contact with at least one support contour on the shift gate.

2. The device for changing the lift of gas exchange valves of an internal combustion engine as recited in claim 1, wherein the shift gate has a first switching contour, a second switching contour opposing the first switching contour, a first support contour and a second support contour opposing the first support contour.

3. The device for changing the lift of gas exchange valves of an internal combustion engine recited in claim 2, wherein the first and second switching contours are axially variable in a peripheral direction so as to provide an axial lift between the changeover pin or thrust pin and the shift gate by the rotation of the camshaft in relation to the shift gate, and the first and second support contours are axially non-variable in the peripheral direction.

4. The device for changing the lift of gas exchange valves of an internal combustion engine as recited in claim 1, wherein first and second mirror-symmetrically opposing switching contours are provided on the shift gate, wherein the first and a second switching contour are arranged in such a way that the perpendicular spacing of the switching contours in relation to one another reduces in the rotational direction of the camshaft and first and second mirror-symmetrically opposing support contours are provided on the shift gate, the first and a second support contour being arranged in such a way that the perpendicular spacing of the first and second support contours in relation to one another remains unchanged.

5. The device for changing the lift of gas exchange valves of an internal combustion engine as recited in claim 4, wherein the first and second mirror-symmetrically opposing switching contours and the first and second mirror-symmetrically opposing support contours are located next to one another on the shift gate.

6. The device for changing the lift of gas exchange valves of an internal combustion engine as recited in claim 1, wherein the changeover pin on the camshaft is arranged spaced apart from the thrust pin and from the support pin in the peripheral direction and is arranged axially spaced apart from the support pin.

7. A method for changing the lift of gas exchange valves of an internal combustion engine using a device as recited in claim 1, the method comprising:

providing a first operative chain having a continuous operative contact of the push rod with the changeover pin to the shift gate;

axially moving the shift gate in relation to the carrier shaft;

canceling the first operative chain after the axially moving;

providing a further operative chain having a continuous operative contact of the push rod with the support pin to the shift gate, and of the shift gate to the thrust pin and accordingly to the cam unit; and moving the cam unit in relation to the carrier shaft.

8. The method for changing the lift of gas exchange valves of an internal combustion engine as recited in claim 7, wherein during the rotation of the camshaft, a locking actuator is extended from a locking contour on the push rod and an adjusting actuator is retracted into an adjusting contour on the push rod, the push rod is thereby axially moved and once the movement has ended, the adjusting actuator is extended from the adjusting contour and the locking actuator is retracted into the locking contour, the changeover pin acts on the switching contour of the shift gate and brings about a movement of the shift gate and thereafter the thrust pin acts on the switching contour and the support pin acts on the support contour and brings about a movement of the cam unit.

* * * * *